US009141062B2

(12) United States Patent
Dobbertin et al.

(10) Patent No.: US 9,141,062 B2
(45) Date of Patent: Sep. 22, 2015

(54) COMPENSATING FOR PRINTING NON-UNIFORMITIES USING A ONE DIMENSIONAL MAP

(71) Applicants: Michael Thomas Dobbertin, Honeoye, NY (US); Richard George Allen, Rochester, NY (US)

(72) Inventors: Michael Thomas Dobbertin, Honeoye, NY (US); Richard George Allen, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/168,311

(22) Filed: Jan. 30, 2014

(65) Prior Publication Data

US 2015/0212470 A1 Jul. 30, 2015

(51) Int. Cl.
*G03G 15/00* (2006.01)

(52) U.S. Cl.
CPC ..... *G03G 15/55* (2013.01)

(58) Field of Classification Search
USPC ..... 399/38, 42, 46, 49; 430/30; 702/137
See application file for complete search history.

(56) References Cited

U.S. PATENT DOCUMENTS

| | | | | |
|---|---|---|---|---|
| 5,546,165 | A | 8/1996 | Rushing et al. | |
| 6,608,641 | B1 | 8/2003 | Alexandrovich et al. | |
| 6,885,833 | B2 | 4/2005 | Stelter et al. | |
| 7,058,325 | B2 | 6/2006 | Hamby et al. | |
| 7,382,507 | B2 | 6/2008 | Wu | |
| 7,755,799 | B2 | 7/2010 | Paul et al. | |
| 2006/0133870 | A1 | 6/2006 | Ng et al. | |
| 2011/0235059 | A1 | 9/2011 | Tai et al. | |
| 2012/0226466 | A1* | 9/2012 | Henderson | 702/137 |
| 2012/0268544 | A1 | 10/2012 | Munechika et al. | |
| 2012/0269527 | A1 | 10/2012 | Kuo et al. | |

* cited by examiner

*Primary Examiner* — Hoan Tran
(74) *Attorney, Agent, or Firm* — Peyton C. Watkins

(57) ABSTRACT

Correction data is produced for density errors in prints produced using a printer. While printing a test image, the periods of rotation of one or more rotatable imaging members arranged along a receiver feed path in the printer are measured using a period sensor. The printed test image is measured in the cross-track direction and a one dimensional map of the period sensors is determined. A reproduction error signal representing deviation from aim density is determined. The variations from the data at measured periods in one or both directions are used to produce a correction signal.

12 Claims, 5 Drawing Sheets

FIG. 2
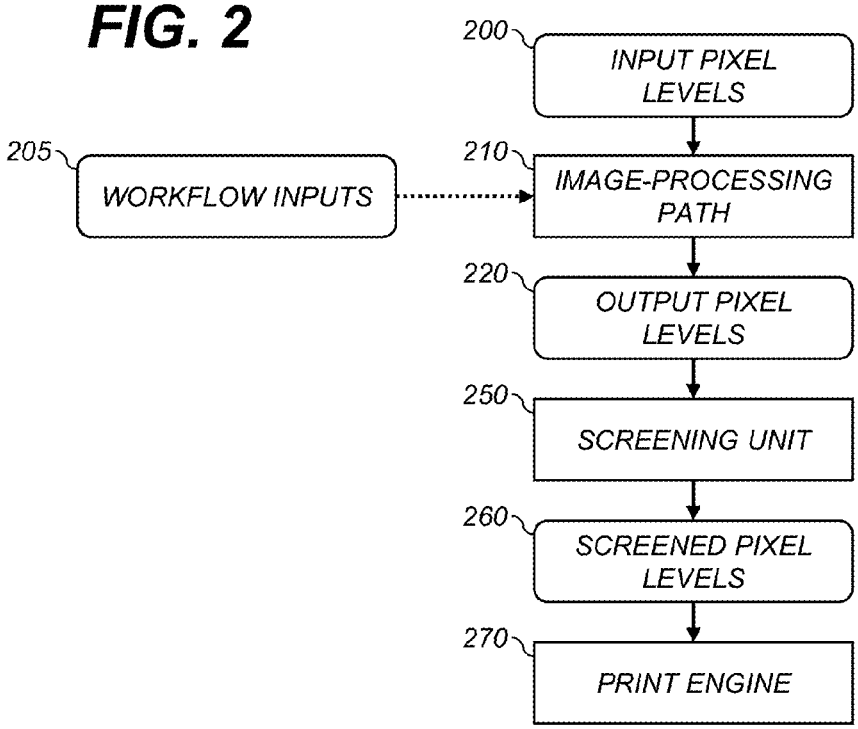
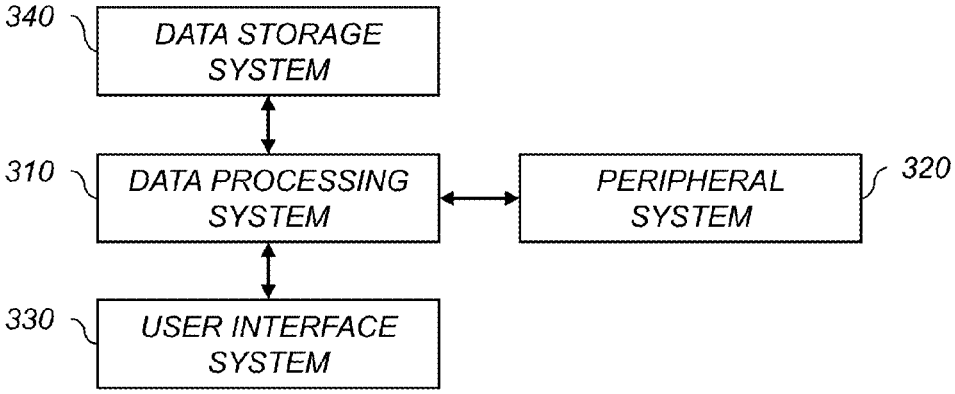
FIG. 3

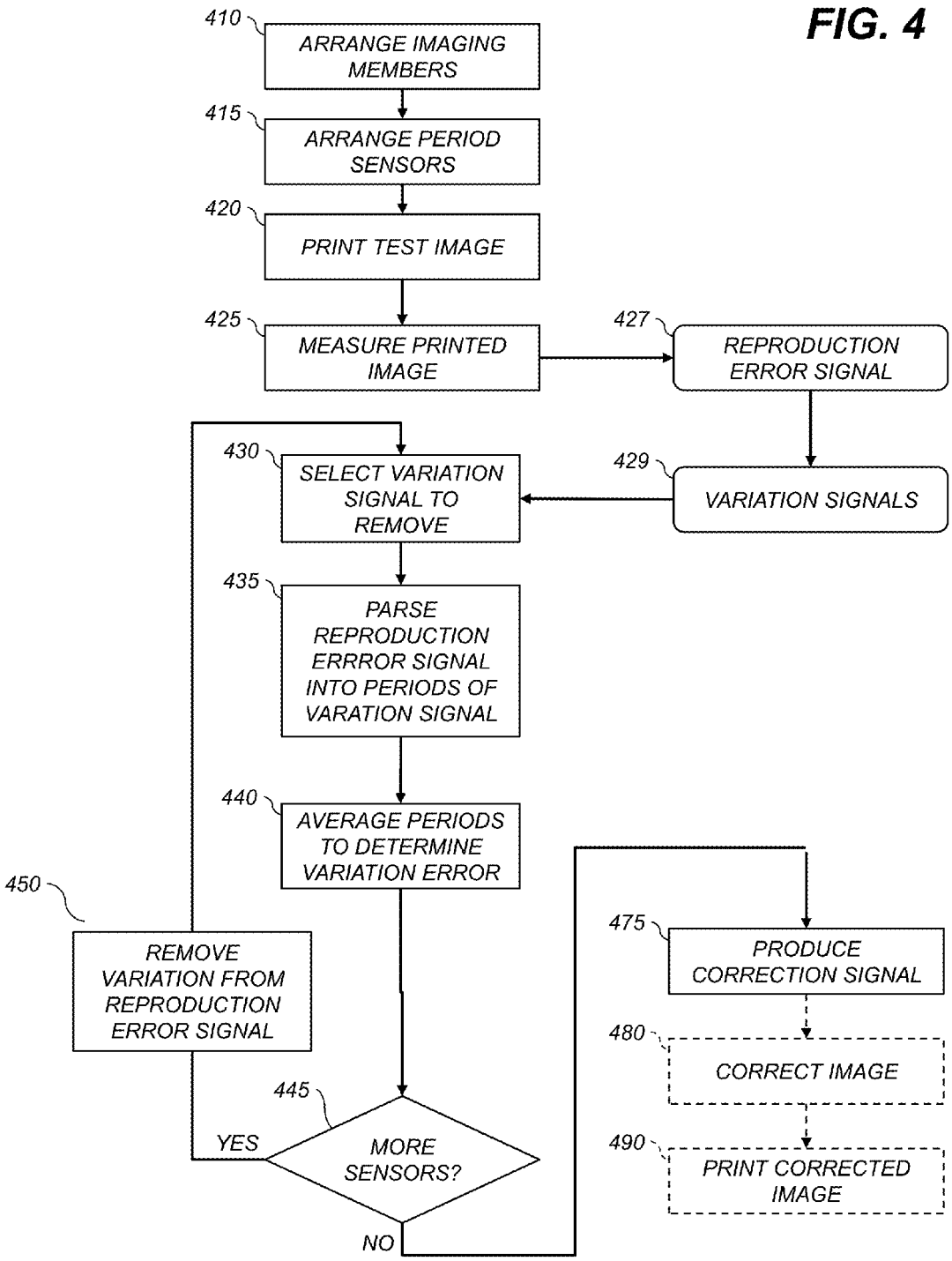
FIG. 4
410
ARRANGE IMAGING MEMBERS
415
ARRANGE PERIOD SENSORS
420
PRINT TEST IMAGE
425
MEASURE PRINTED IMAGE
427
REPRODUCTION ERROR SIGNAL
429
VARIATION SIGNALS
430
SELECT VARIATION SIGNAL TO REMOVE
435
PARSE REPRODUCTION ERRROR SIGNAL INTO PERIODS OF VARATION SIGNAL
440
AVERAGE PERIODS TO DETERMINE VARIATION ERROR
450
REMOVE VARIATION FROM REPRODUCTION ERROR SIGNAL
445
MORE SENSORS?
YES
NO
475
PRODUCE CORRECTION SIGNAL
480
CORRECT IMAGE
490
PRINT CORRECTED IMAGE

COMPENSATING FOR PRINTING NON-UNIFORMITIES USING A ONE DIMENSIONAL MAP

CROSS-REFERENCE TO RELATED APPLICATIONS

This application has related subject matter to U.S. patent application Ser. No. 13/076,467, filed Mar. 31, 2011, titled "COMPENSATING FOR PERIODIC NONUNIFORMITY IN ELECTROPHOTOGRAPHIC PRINTER," by Thomas A. Henderson et al., and U.S. patent application Ser. No. 13/331,075, filed Dec. 20, 2011, titled "PRODUCING CORRECTION DATA FOR PRINTER," by Chung-Hui Kuo et al, U.S. patent application Ser. No. 14/168,289 filed concurrently herewith, titled COMPENSATING FOR PRINTING NON-UNIFORMITIES USING A TWO DIMENSIONAL MAP, by Michael T. Dobbertin et al., the disclosures of which are incorporated herein by reference.

FIELD OF THE INVENTION

This invention pertains to the field of printing and more particularly to compensating for non-uniformities in prints.

BACKGROUND OF THE INVENTION

Printers are useful for producing printed images of a wide range of types. Printers print on receivers (or "imaging substrates"), such as pieces or sheets of paper or other planar media, glass, fabric, metal, or other objects. Printers typically operate using subtractive color: a substantially reflective receiver is overcoated image-wise with cyan (C), magenta (M), yellow (Y), black (K), and other colorants. Various schemes can be used to process images to be printed. Printers can operate by inkjet, electrophotography, and other processes.

In the electrophotographic (EP) process, an electrostatic latent image is formed on a photoreceptor by uniformly charging the photoreceptor and then discharging selected areas of the uniform charge to yield an electrostatic charge pattern corresponding to the desired image (a "latent image"). After the latent image is formed, charged toner particles are brought into the vicinity of the photoreceptor and are attracted to the latent image to develop the latent image into a visible image. Note that the visible image may not be visible to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

Printers typically transport the receiver past an imaging element (e.g., the photoreceptor) to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Various components used in printing processes, such as belts and drums, can have mechanical or electrical characteristics that result in periodic objectionable non-uniformities in print images, such as streaks (extending in-track), bands (extending cross-track) and irregular two dimensional patterns. For example, drums can experience run out: they can be elliptical rather than circular in cross-section, or can be mounted slightly off-center, so that the radius of the drum at a particular angle with the horizontal varies over time. Likewise, they may have irregular deformities to their shape or surface characteristics. Belts can have thicknesses that vary across their widths (cross-track) or along their lengths (in-track). Damped springs for mounting components can experience periodic vibrations, causing the spacing between the mounted components to change over time. These variations can be periodic in nature, that is, each variation cycles through various magnitudes repeatedly in sequence, at a characteristic and generally fixed frequency. The variations can also be non-periodic. For example, two cooperating drums with periodic non-uniformities at frequencies whose ratio is irrational will produce a non-periodic nonuniformity between them.

Various schemes have been proposed for correcting image artifacts in prints, including those resulting from these mechanical or electrical variations.

U.S. Pat. No. 7,058,325 to Hamby et al. deposits a test patch, measures its density, and corrects using a feedback or feedforward control routine. U.S. Pat. No. 5,546,165 to Rushing et al. scans a document to be reproduced, and the resulting reproduction, and adjusts for calibration errors in the processing of the image of the document. U.S. Pat. No. 6,885,833 to Stelter et al. detects variations and periodicities of densities in a print. U.S. Pat. No. 7,755,799 to Paul et al. also measures test patches, and uses a defect once-around signal to synchronize the measurements to the rotation of the drum. The once-around signal is derived from an optical sensor monitoring the drum's position. Paul describes that the phase of a periodic banding defect (an artifact extending cross-track) is difficult to measure because, unlike frequency, it varies from page to page. U.S. Pat. No. 7,382,507 to Wu analyzes test patterns to generate image quality defect records and stores the records in a database for later analysis.

However, often times the non-uniformities are somewhat irregular rather than a smooth sinusoidal function. This is especially evident when considering two dimensional non-uniformities in dimensional or surface properties. For these cases, a map of one period of rotation of the rotating member can best represent the variation. This can be either a look up table or by applying functions that estimate variation in one or both directions.

SUMMARY OF THE INVENTION

A method for compensating for imaging defects in an electro-photographic imaging system, the method comprising the steps of providing one or more imaging elements that rotates while printing; determining positions on the one or more imaging elements using a period sensor while printing an image of known target density; measuring the density image at one cross-track location; determining a one dimensional map of the in-track density for each of the one or more period sensors; wherein each of the imaging maps corresponds to positions on the one or more imaging elements; comparing the printed density at each of the positions of the imaging maps to the known target density for determining an error signal; determining a variation correction signal for the one or more period sensors based on the error signal; and applying the all the variation correction signals synchronized to the positions of the one or more period sensors when printing subsequent prints to improve image uniformity.

An advantage of this invention is that it compensates for periodic nonuniformities with known sources and for nonuniformities that are irregular in shape or contour with known sources and for non-uniformities without known sources. The period sensors provide a means to synchronize the compensation to one or more components. Synchronizing individual components simplifies the measurement and compensation, reducing it to a single compensation map.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIG. 2 is a schematic of a data-processing path;

FIG. 3 is a high-level diagram showing components of a processing system useful with various embodiments;

FIG. 4 shows various embodiments of methods of producing correction data for a printer;

Figure 1:
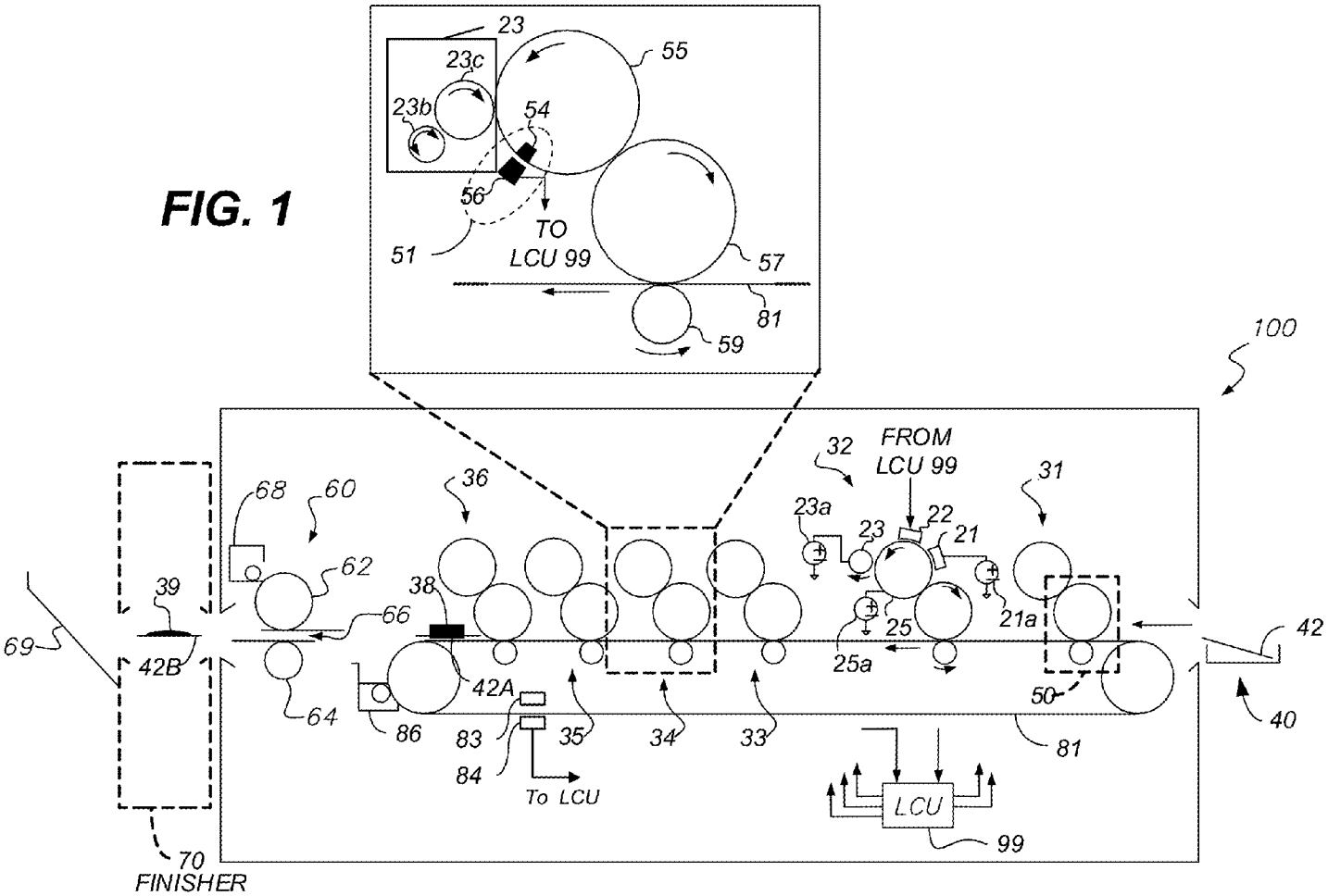
FIG. 1 is an elevational cross-section of an electrophotographic reproduction apparatus.

The attached drawings are for purposes of illustration and are not necessarily to scale.

DETAILED DESCRIPTION OF THE INVENTION

In the following description, some embodiments will be described in terms that would ordinarily be implemented as software programs. Those skilled in the art will readily recognize that the equivalent of such software can also be constructed in hardware. Because data-manipulation algorithms and systems are well known, the present description will be directed in particular to algorithms and systems forming part of, or cooperating more directly with, methods described herein. Other aspects of such algorithms and systems, and hardware or software for producing and otherwise processing the compensation data and image signals involved therewith, not specifically shown or described herein, are selected from such systems, algorithms, components, and elements known in the art. Given the system as described herein, software not specifically shown, suggested, or described herein that is useful for implementation of various embodiments is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods according to various embodiments.

The electrophotographic (EP) printing process can be embodied in devices including printers, copiers, scanners, and facsimiles, and analog or digital devices, all of which are referred to herein as "printers." Electrostatographic printers such as electrophotographic printers that employ toner developed on an electrophotographic receiver can be used, as can ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. An embodiment involves printing using an electrophotographic print engine having six sets of single-color image-producing or -printing stations or modules arranged in tandem, but more or fewer than six colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module 31, 32, 33, 34, 35, 36 produces a single-color toner image for transfer using a respective transfer subsystem 50 (for clarity, only one is labeled) to a receiver 42 successively moved through the modules 31, 32, 33, 34, 35, 36. Receiver 42 is transported from a supply unit 40, which can include active feeding subsystems as known in the art, into printer 100. In various embodiments, the visible image can be transferred directly from an imaging roller to the receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around a photoreceptor 25 are arranged, ordered by the direction of rotation of photoreceptor 25, a charger 21, an exposure subsystem 22, and a toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image might not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form a desired print image 38 on the receiver, as shown on receiver 42A. The imaging process is typically repeated many times with reusable photoreceptors 25.

Receiver 42A is then removed from its operative association with photoreceptor 25 and subjected to heat or pressure to permanently fix ("fuse") print image 38 to receiver 42A. Plural print images, e.g. of separations of different colors, are overlaid on one receiver before fusing to form the multi-color print image 38 on receiver 42A.

The inset for printing module 34 shows additional details that can also be present in all six printing modules 31, 32, 33, 34, 35, 36. For clarity, these components are only shown with respect to printing module 34. A photoreceptor 55 (corresponding to photoreceptor 25 in printing module 32) has developed thereon a visible image containing toner. Photoreceptor 55 is in contact with an intermediate transfer member 57, which can be a belt or drum and can have a compliant surface. The visible image is transferred from photoreceptor 25 to intermediate transfer member 57 as the two rotate. The visible image is then transferred to receiver 42 travelling on a transport web 81 by pressure between intermediate transfer member 57 and a transfer backup member 59 (e.g., a roller), and by an electric field applied between members 57, 59.

The feed path of receiver 42, in this example, is the path from supply unit 40 along transport web 81, through a fuser 60 and a finisher 70, and to an output tray 69. Along the feed path, there is a plurality of rotatable imaging members, such as those discussed above. Transport web 81 is also an imaging member. "Imaging members" are those members for which variations in rotational speed or other properties affect the image quality of a print.

One or more period sensors are arranged in operative arrangement with respective rotatable imaging members in the printer. "Period sensors" can be sensors that detect period directly, or detect frequency and convert it to period. Period sensors also detect phase. Each period sensor is arranged so that it can detect the period of rotation and the phase of the corresponding rotatable imaging member. In this example, photoreceptor 55 is a drum, and a period sensor 51 consists of an optical or magnetic flag 54 that is affixed to one end of photoreceptor 55 and rotates with it and a flag sensor 56. Alternately, the flag sensor 56 can detect a flag mounted on a drive element that is indicative of 1 or an integral multiple revolutions of the imaging member. For instance, the flag sensor 56 can detect a flag that is mounted on the drive chain (or belt) for the toning shell if the drive chain (or belt) has twice as many pitches as the toning shell sprocket. Flag sensor 56 is fixed and detects flag 54 when flag 54 rotates past sensor 56. Flag sensor 56 reports the times between successive passes of flag 54 to a logic and control unit (LCU) 99. Period sensors 51 can operate optically (e.g., an optointerruptor), magnetically (e.g., a magnet moving past a coil to produce current, such as in a magneto), electrically (e.g., flag 54 can have a different capacitance than the surrounding area, so when flag 54 passes flag sensor 56, an electric field between the two detectably changes in magnitude), mechanically (e.g., a pawl that trips a microswitch), or by combinations or other mechanisms (e.g., an optical encoder).

Each receiver 42, during a single pass through the six printing modules 31, 32, 33, 34, 35, 36, can have transferred in registration thereto up to six single-color toner images to form a pentachrome image. As used herein, the term "hexachrome" implies that in a print image, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an embodiment, printing module 31 forms black (K) print images, printing module 32 forms yellow (Y) print images, printing module 33 forms magenta (M) print images, printing module 34 forms cyan (C) print images, printing module 35 forms light-black (Lk) images, and printing module 36 forms clear images.

In various embodiments, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. Print image 38 on receiver 42A includes unfused toner particles.

Subsequent to transfer of the respective print images 38, overlaid in registration, one from each of the respective printing modules 31, 32, 33, 34, 35, 36, receiver 42A is advanced to the fuser 60, i.e. a fusing or fixing assembly, to fuse print image 38 to receiver 42A. Transport web 81 transports the print-image-carrying receivers (e.g., 42A) to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at a cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

In an alternative embodiment unfused toner can be applied directly to the transport web 81 and then transported past an inline densitometer attached to the printer. There are various designs for inline densitometer scanners including reflection and transmissive types. One such example of the transmissive style of densitometer is shown consisting of a light source 83 and a light sensor 84 an inline scanner. When the unfused toner test image is transported past the light source using radiation (such as infrared light) that is not absorbed by the transport web 81 but is readily absorbed or scattered by the unfused toner the resulting modulation of the light intensity sensed at the light sensor can be transformed into density or toner laydown measurement using conventional ways.

Fuser 60 includes a heated fusing roller 62 and an opposing pressure roller 64 that form a fusing nip 66 therebetween. In an embodiment, fuser 60 also includes the release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver 42. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fuser 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. A voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Patent Application Publication No. 2006/0133870, published on Jun. 22, 2006, by Yee S. Ng et al., the disclosures of which are incorporated herein by reference.

FIG. 2 shows a data-processing path, and defines several terms used herein. Printer 100 (FIG. 1) or corresponding electronics (e.g. the DFE or RIP), described herein, operate this datapath to produce image data corresponding to exposure to be applied to a photoreceptor, as described above. The datapath can be partitioned in various ways between the DFE and the print engine, as is known in the image-processing art.

The following discussion relates to a single pixel; in operation, data processing takes place for a plurality of pixels that together compose an image. The term "resolution" herein refers to spatial resolution, e.g. in cycles per degree. The term "bit depth" refers to the range and precision of values. Each set of pixel levels has a corresponding set of pixel locations. Each pixel location is the set of coordinates on the surface of receiver 42 (FIG. 1) at which an amount of toner corresponding to the respective pixel level should be applied.

Printer 100 receives input pixel levels 200. These can be any level known in the art, e.g. sRGB code values (0 . . . 255) for red, green, and blue (R, G, B) color channels. There is one pixel level for each color channel. Input pixel levels 200 can be in an additive or subtractive space. An image-processing path 210 converts input pixel levels 200 to output pixel levels 220, which can be cyan, magenta, yellow (CMY); cyan, magenta, yellow, black (CMYK); or values in another subtractive color space. This conversion can be part of the color-management system discussed above. Output pixel level 220 can be linear or non-linear with respect to exposure, L*, or other factors known in the art.

Image-processing path 210 transforms input pixel levels 200 of input color channels (e.g. R) in an input color space (e.g. sRGB) to output pixel levels 220 of output color channels (e.g. C) in an output color space (e.g. CMYK). In various embodiments, image-processing path 210 transforms input pixel levels 200 to desired CIELAB (CIE 1976 L*a*b*; CIE Pub. 15:2004, 3rd. ed., §8.2.1) values or ICC PCS (Profile Connection Space) LAB values, and thence optionally to values representing the desired color in a wide-gamut encoding such as ROMM RGB. The CIELAB, PCS LAB or ROMM RGB values are then transformed to device-dependent CMYK values to maintain the desired colorimetry of the pixels. Image-processing path 210 can use optional workflow inputs 205, e.g. ICC profiles of the image and the printer 100, to calculate the output pixel levels 220. RGB can be converted to CMYK according to the Specifications for Web Offset Publications (SWOP; ANSI CGATS TR001 and CGATS.6), Euroscale (ISO 2846-1:2006 and ISO 12647), or other CMYK standards.

Input pixels are associated with an input resolution in pixels per inch (ippi, input pixels per inch), and output pixels with an output resolution (oppi). Image-processing path 210 scales or crops the image, e.g. using bicubic interpolation, to change resolutions when ippi # oppi. The following steps in the path (output pixel levels 220, screened pixel levels 260) are preferably also performed at oppi, but each can be a different resolution, with suitable scaling or cropping operations between them.

A screening unit 250 calculates screened pixel levels 260 from output pixel levels 220. Screening unit 250 can perform continuous-tone (processing), halftone, multitone, or multi-level halftone processing, and can include a screening memory or dither bitmaps. Screened pixel levels 260 are at the bit depth required by a print engine 270.

Print engine 270 represents the subsystems in printer 100 that apply an amount of toner corresponding to the screened pixel levels to the receiver 42 (FIG. 1) at the respective screened pixel locations. Examples of these subsystems are described above with reference to FIG. 1. The screened pixel levels and locations can be the engine pixel levels and locations, or additional processing can be performed to transform the screened pixel levels and locations into the engine pixel levels and locations.

FIG. 3 is a high-level diagram showing components of a processing system useful with various embodiments. The system includes a data processing system 310, a peripheral system 320, a user interface system 330, and a data storage system 340. Peripheral system 320, user interface system 330 and data storage system 340 are communicatively connected to data processing system 310.

Data processing system 310 includes one or more data processing devices that implement the processes of various embodiments, including the example processes described herein. The phrases "data processing device" or "data processor" are intended to include any data processing device, such as a central processing unit ("CPU"), a desktop computer, a laptop computer, a mainframe computer, a personal digital assistant, a Blackberry™, a digital camera, cellular phone, or any other device for processing data, managing data, or handling data, whether implemented with electrical, magnetic, optical, biological components, or otherwise.

Data storage system 340 includes one or more processor-accessible memories configured to store information, including the information needed to execute the processes of the various embodiments, including the example processes described herein. Data storage system 340 can be a distributed processor-accessible memory system including multiple processor-accessible memories communicatively connected to data processing system 310 via a plurality of computers or devices. On the other hand, data storage system 340 need not be a distributed processor-accessible memory system and, consequently, can include one or more processor-accessible memories located within a single data processor or device.

The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, ROMs, and RAMs.

The phrase "communicatively connected" is intended to include any type of connection, whether wired or wireless, between devices, data processors, or programs in which data can be communicated. The phrase "communicatively connected" is intended to include a connection between devices or programs within a single data processor, a connection between devices or programs located in different data processors, and a connection between devices not located in data processors at all. In this regard, although the data storage system 340 is shown separately from data processing system 310, one skilled in the art will appreciate that data storage system 340 can be stored completely or partially within data processing system 310. Further in this regard, although peripheral system 320 and user interface system 330 are shown separately from data processing system 310, one skilled in the art will appreciate that one or both of such systems can be stored completely or partially within data processing system 310.

Peripheral system 320 can include one or more devices configured to provide digital content records to data processing system 310. For example, peripheral system 320 can include digital still cameras, digital video cameras, cellular phones, or other data processors. Data processing system 310, upon receipt of digital content records from a device in peripheral system 320, can store such digital content records in data storage system 340. Peripheral system 320 can also include a printer interface for causing a printer to produce output corresponding to digital content records stored in data storage system 340 or produced by data processing system 310.

User interface system 330 can include a mouse, a keyboard, another computer, or any device or combination of devices from which data is input to data processing system 310. In this regard, although peripheral system 320 is shown separately from user interface system 330, peripheral system 320 can be included as part of user interface system 330.

User interface system 330 also can include a display device, a processor-accessible memory, or any device or combination of devices to which data is output by data processing system 310. In this regard, if user interface system 330 includes a processor-accessible memory, such memory can be part of data storage system 340 even though user interface system 330 and data storage system 340 are shown separately in FIG. 3.

FIG. 4 shows various embodiments of methods of producing correction data for a printer. Processing begins with step 410.

In step 410, a plurality of rotatable imaging members are arranged along a receiver feed path in the printer. Rotatable imaging members can include belts, drums, or other members that undergo periodic motion and that have an effect on the printed image. Examples include photoreceptors, transport belts, and other components shown in FIG. 1. Rotatable imaging members do not have to participate directly in moving colorant if they have an effect on the printed image. For example, in an electrophotographic (EP) printer, a toning roller 23*c* and toning auger 23*b* in toning station 23 (FIG. 1) are a rotatable imaging member even though no "image" is formed on them. The quality of toner transfer from toning station 23 to photoreceptor 25 (FIG. 1) can affect image quality. Step 410 is followed by step 415.

In step 415, one or more period sensors 51 (FIG. 1) are arranged in operative arrangement with respective rotatable imaging members. Each period sensor 51 detects the period of rotation of the corresponding rotatable imaging member. Period sensors 51 can additionally detect phase. They can also detect frequency and convert it to phase; as used herein, frequency and period are considered interchangeable since either can be used. Period sensors 51 are discussed above with respect to FIG. 1. Step 415 is followed by step 420.

Figure 5:
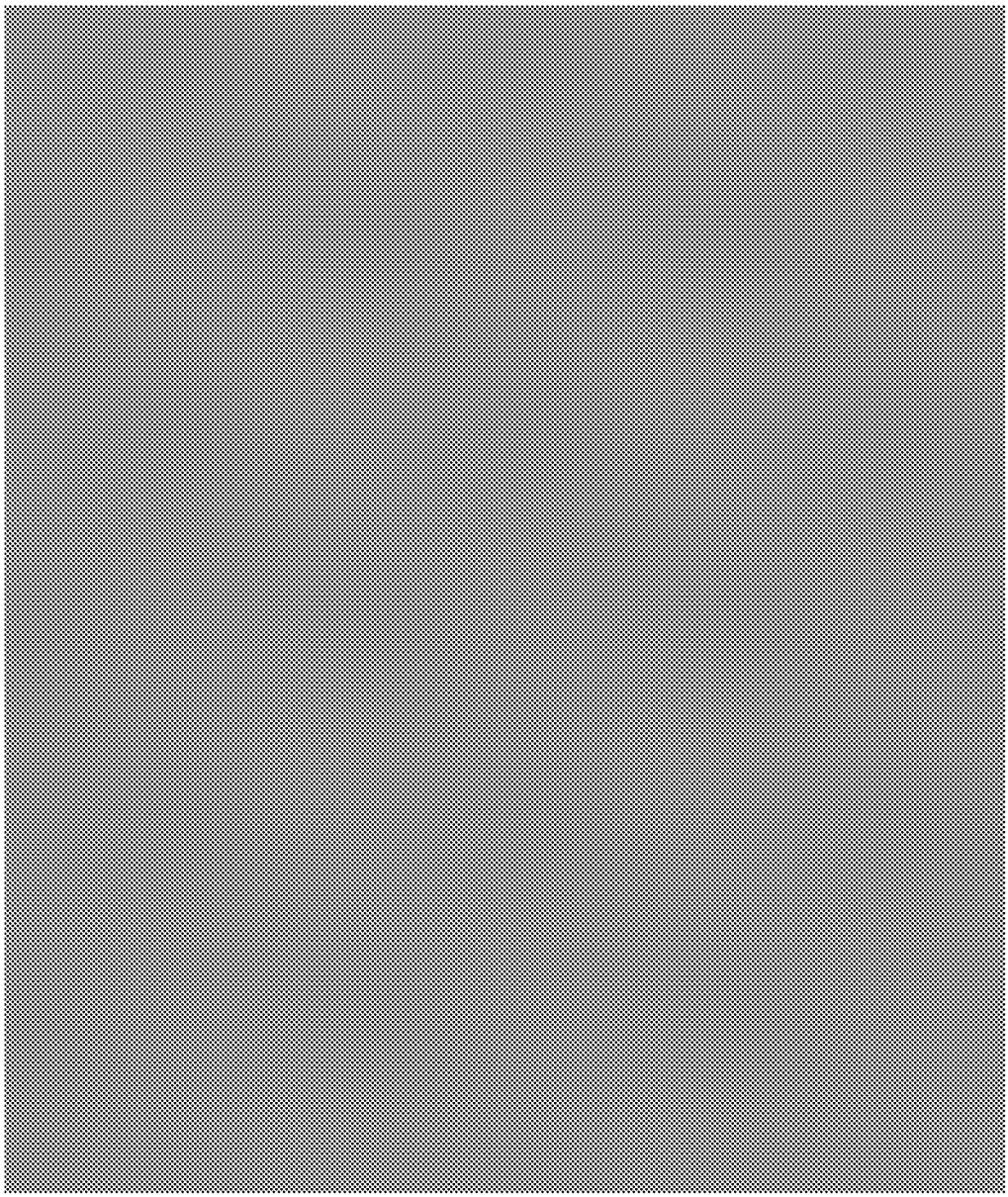
FIG. 5 shows flat-field target image.
Figure 6:
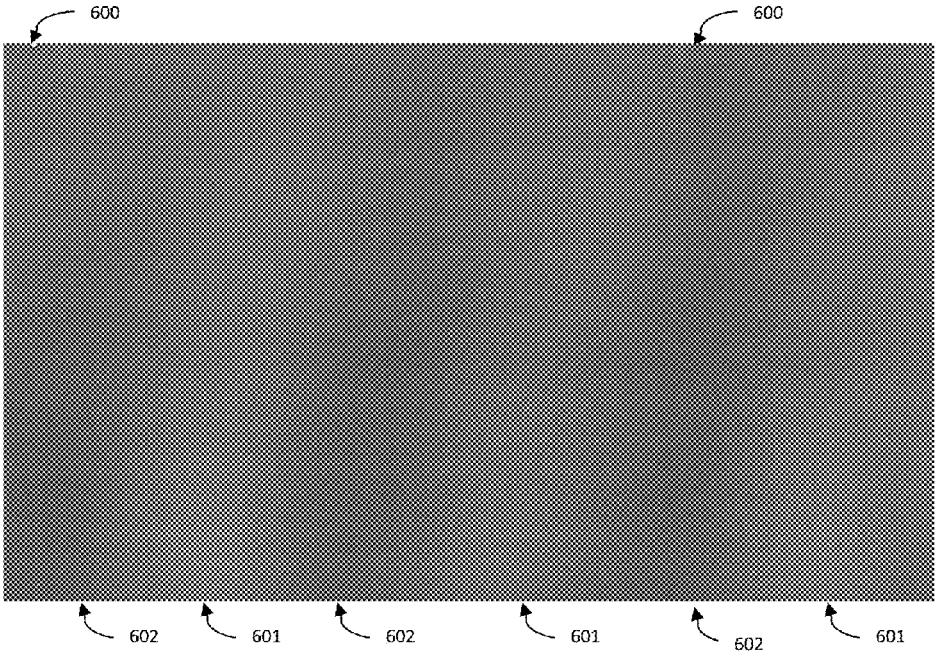
FIG. 6 shows a typical print a constant density image.

In step 420, a test image is printed using the rotatable imaging members, and optionally also other members. The test image is defined by an aim density pattern. An example of a test target (test image to be printed) is shown in FIG. 5. While the test target is being printed, the period sensors simultaneously record the respective periods and phases of the corresponding imaging members. FIG. 6 depicts a typical print 420 of a constant density image including two dimensional periodic density variations seen in printing. This print 420 can include areas of higher print density 601 and areas of lower print density 602. The print may also include fiducials 600 to denote the phase of the rotating imaging member(s). If the period is too long to capture on a single printed page, it can be printed in segments on successive pages with multiple fiducials 600 to indicate the phase of each member on each sheet.

Step 420 is followed by step 425. In step 425, the printed test image is measured along a selected measurement direction, i.e., along one or more traces substantially parallel to the direction. The measurement can be performed using an offline scanner, e.g., a flatbed scanner, or an inline scanner attached to the printer. A reproduced density pattern is determined from the measurements, and a reproduction error signal 427 is determined using the aim density pattern and the reproduced density pattern for the entire measured printed area.

Reproduction error signal 427 is the difference between the aim density pattern, which represents what output the printer should produce, and the reproduced density pattern, which represents what the printer did produce. Reproduction error signal 427 can be scaled, weighted, or transformed (linearly or nonlinearly). Step 425 produces reproduction error signal 427, which is decomposed to produce variation signals 429, which are provided to step 430.

As used herein, an "error" is a deviation from desired print density of a selected area on a printed test target. It is thus the difference between the aim density pattern and the reproduced density pattern in a selected test area of the printed test image. A "variation" is the cause of an error, e.g., a defect in the printer. Errors can be most clearly visible in flat fields of various sizes, but flat-field test targets do not have to be used. Reproduction error signal 427 is a signal, electrical (analog or digital) or otherwise, representing the magnitude of errors produced by the printer while printing the printed test image.

Some variations can be substantially constant in the in-track direction, manifest as in-track streaks. These are due to static defects, such as a non-uniform exposure or charging. These variations are grouped together and referred to as the static variation. In addition, a portion of the variation can be due to one or more rotatable imaging members that are measured by period sensors. These are referred to as periodic variations. There is one such periodic variation per measured period sensor, which defines the period and phase of the rotating imaging member. Collectively, these are referred to as variation signals 429. These variation signals 429 are decomposed from reproduction error signal 427. This method does not compensate for other variations that are neither static nor occur in rotatable imaging members that are not measured by period sensors. To produce improved prints that do not show errors, correction signals are applied. One correction signal can be produced for each variation signal.

Reproduction error signal 427 determined in step 425 is processed to determine errors that are static and those due to rotatable imaging members that are measured by period sensors 51 (FIG. 1). Steps 430-450 are performed one or more times to process data from each period sensor 51 desired to be processed. Additional period sensors 51 can be present but not measured, or measured but not processed. Steps 430-450 are shown as being performed once for each period sensor 51 to be processed (a serial or "depth-first" approach). However, these steps can also be performed in parallel: step 430 can be performed for each period sensor 51, then step 435 can be performed for each period sensor, then step 440 can be performed for each period sensor 51, and then step 450 can be performed for each period sensor 51 (a parallel or "breadth-first" approach). Combinations of the depth-first and breadth-first methods can also be used. For example, step 435 can be performed for each period sensor 51, then steps 440-450 can be performed for each period sensor 51. Care must be taken not to double count the effects of variation signals analyzed in parallel. The following describes the depth-first approach shown in FIG. 4, without limitation.

In step 430, a variation signal is selected to be removed from the reproduction error signal 427. In a preferred embodiment, the static variation is selected first, followed by the periodic variation expected to have the largest signal and so on. In step 435, the reproduction error signal 427 is parsed into "N" periods for the selected variation signal. This period is defined as the smallest increment of in-track distance for the static variation and as the imaging distance between the respective sensor signals for the periodic variations. The error signal at every location of the "N" periods is averaged 440 to determine the variation error for the signal selected in step 430. N is the integral quotient of the reproduction error signal length divided by the period of that variation signal. The variation error determined in step 440 is one dimensional for the static variation (cross-track only) and two dimensional for each periodic variation (in-track and cross-track).

Figure 7:
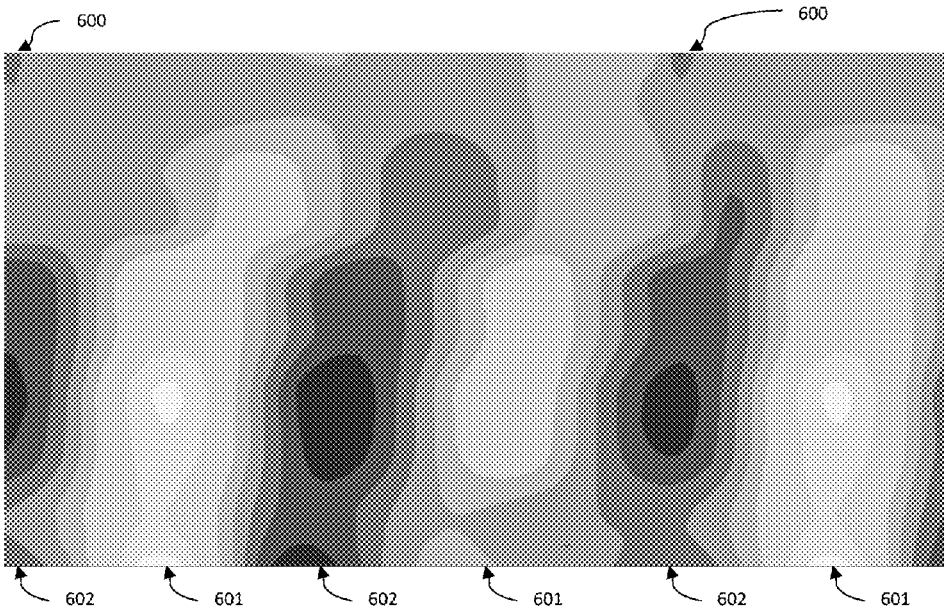
FIG. 7 is a graphical depiction of a periodic variation error.

FIG. 7 is a graphical depiction of a periodic variation error. This specific example is the periodic variation error associated with the toning roller 23*c* in the toning station 23 used to produce the printed image 420 in FIG. 6. Note the corresponding areas of lower density 601 and higher print density 602 and the fiducials 600 and the spatial relationship among them between figures.

If it is determined in step 445 that there are more variation signals to decompose, the reproduction error signal 427 is modified by subtracting the variation error in step 440 for each period in step 450. Steps 430-450 are then iterated for this new reproduction error signal 427 until all variation signals are decomposed.

In step 475, a correction signal is automatically produced using the variation correction signals determined iteratively in step 450. The variation error correction signal from step 450 for the static variation is applied continuously. The variation error correction signals from step 450 for the periodic variation are applied based on the actuation of the respective period sensor. The application of these variation error corrections is defined as applying a transform to alter one or more machine control parameter(s) based on these variation errors to produce a correction signal 475 which has reduced density variation. In a preferred embodiment, this machine control parameter is the exposure. This correction signal 475 is then used to correct the image in step 480. The corrected image in step 480 is then printed in step 490.

If only a single member variation signal 429 is to be compensated for, the static portion can be included in this analysis. If multiple member variation signals 429 are to be decomposed, the static variation signal 429 in step 440 must be subtracted out of the reproduction error signal 427 first so that it is not overcompensated by including it in each member variation signal 429. If two or more distinct member variations signals 429 are decomposed, the number of periods that are averaged for each member variation signal 429 must be large enough so that the effects of the other member variation signals 429 are reduced due to averaging the variations.

If multiple member variation signals 429 are synchronized, the least common multiple of the periods can be used to represent the composite error of those rotatable imaging members. In a preferred embodiment, two or more critical rotating imaging members are synchronized to reduce the measurement and compensation time and complexity. For instance the rotation of the toning roller 23*c* could be slaved to that of the imaging cylinder such that the period of revolution of the toning roller 23*c* is an integral quotient of the period of the imaging cylinder and the toning roller 23*c* remained in phase with the imaging cylinder.

The correction signal 475 can be in a variety of formats. For instance, it can be a look up table, mapping out correction values for each pixel in a two dimensional map that extends the full cross-track imaging width X the period of the variation signal. Similarly, the correction signal could be condensed by grouping 2 or more individual pixels together to reduce the size of the correction matrix. Alternatively, the correction signal 475 can be estimated by a function generated from the raw correction signal Likewise, the cross-track and in-track variation errors can be decomposed and corrected independently. In this case, the static variation signal is decomposed as described above (cross-track variation). In a similar manner, the density error is averaged across the entire imaging width for each in-track location for each periodic variation signal. Alternatively, the in-track variation could be assumed to be constant across the imaging width and only measured a one or a few points, calculating the in-track correction solely on those measurements. While these methods are not as accurate for non-uniform variations, they may be significantly simpler and faster to measure, calculate and apply.

In an example, the correction signal 475 includes digital values (positive, negative, or zero) to be added to the exposure data values to the exposure unit to compensate for the errors. In other embodiments, the correction signal 475 includes values indicating that certain pixels should be exposed at a different location on the receiver than normal. For example, a pixel can be moved in the in-track direction by advancing or delaying the time at which the exposure unit begins to emit light corresponding to that pixel. The correction signal 475 can also include values indicating that voltages or other physical parameters of the printer should be changed.

The correction signal 475 can apply to each cross-track position, or only to some cross-track positions, and can vary with time or with the phase of various members in the printer (e.g., those measured by period sensors 51).

In an embodiment, the correction signal includes exposure modification values. These are computed by inverting the variation error terms in step 440 of the variation signals. In a DAD system, if a pixel is too bright (is overly-reflective), exposure is increased. The correction signal 475 therefore includes positive values for overly-bright pixels to increase their exposure and reduce their reflectance.

In various embodiments useful with EP printers, the correction signal 475 includes one or more specification(s) of, or adjustment(s) to, the voltage of the primary charger or the bias of the toning station. These can be used together with exposure modification values to provide increased correction range. These can be used to compensate for banding artifacts and other artifacts extending in the cross-track direction.

In various embodiments, de-screening is performed on the scanned data of the printed test image before measuring its densities. De-screening can be performed using, e.g., a Gaussian filter.

In various embodiments, a multilevel streak extraction process is performed on each variation signal. A spline function having a non-uniform knot placement is used to model the overall density fluctuations at each density level. Streak signals are the difference between the profiles and the fitted spline curves in an embodiment. Streak signals can be represented in the code-value space and its logarithmic space.

The streak signals are decorrelated using a singular value decomposition. The first component is extracted as the correction profile and the remaining signal used to refine the correction profile to better address fine and sharp edges in an embodiment. The correction gain is produced by linearly fitting the streak signal on the extracted correction profile in the logarithmic space. The slope is used as the correction gain coefficient.

In various embodiments, the measured densities in each variation signal are plotted against the aim densities. This mapping is then inverted, and optionally smoothed, to provide a correction signal that maps aim density to the modified density to command from the printer. Further details of this and other embodiments are given in commonly-assigned U.S. Patent Application Publication Nos. 2012/0269527; 2012/0268544; and 2011/0235059, the disclosures of which are incorporated herein by reference.

In optional step 480, the correction signal 475 is applied to the image data to produce corrected image data. This can be performed while each row of image data is being supplied to the exposure unit, or as a pre-processing step. Step 480 is followed by step 490.

When exposure subsystem 22 is an LED printhead, the alignment marks can be used to locate the exact LED array locations on the printhead. The correction can be tuned for any one of the given tone densities. For example, in one embodiment, the correction is tuned for a mid-tone density. Other embodiments of test targets can be used, such as KODAK ICS targets or other targets with density bars, flat field targets, registration targets (which include multicolor bars), large-patch checkerboard test targets, or small-patch checkerboard targets (e.g., every other pixel printed and the rest not, or one-on, two-off).

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
23*b* auger
23*c* toning roller
25 photoreceptor
25*a* voltage source
31, 32, 33, 34, 35, 36 printing module
38 print image
39 fused image
40 supply unit
42, 42A, 42B receiver
50 transfer subsystem
51 period sensor
54 flag
55 photoreceptor
56 flag sensor
57 intermediate transfer member
59 transfer backup member
60 fuser
62 fusing roller
64 pressure roller
66 fusing nip
68 release fluid application substation
69 output tray
70 finisher
81 transport web
83 light source
84 light sensor
86 cleaning station
99 logic and control unit (LCU)
100 printer
200 input pixel levels
205 workflow inputs
210 image-processing path
220 output pixel levels
250 screening unit
260 screened pixel levels
270 print engine
310 data processing system
320 peripheral system
330 user interface system
340 data storage system
410 arrange imaging members step
415 arrange period sensors step
420 print test image step
425 measure printed image step
427 reproduction error signal
429 variation signals
430 determine select periodic variation signal to remove step
435 parse reproduction error step
440 decompose reproduction error signal step
445 more sensors? decision step
450 adjusted reproduction error signal
475 produce correction signal step
480 correct image step
490 print corrected image step
600 Fiducials to indicate phase
601 Area of higher print density
602 Area of lower print

The invention claimed is:

1. A method for compensating for imaging defects in an electro-photographic imaging system, the method comprising the steps of:

(a) providing one or more imaging elements that rotates while printing;

(b) determining positions on the one or more imaging elements using a period sensor for each imaging element while printing an image of known target density;

(c) measuring the density image at one cross-track location;

(d) determining a one dimensional map of the in-track density for each period sensor; wherein each of the imaging maps corresponds to positions on the one or more imaging elements;

(e) comparing the printed density at each of the positions of the imaging maps to the known target density for determining an error signal;

(f) determining a variation correction signal for each period sensor based on the error signal; and (g) applying all the variation correction signals synchronized to the positions of each period sensor when printing subsequent prints to improve image uniformity.

2. The method as in claim 1, wherein the one or more imaging elements is either a rotating imaging cylinder or a rotating toning roller.

3. The method as in claim 1, wherein the one or more imaging elements includes both a rotating imaging cylinder and a rotating toning roller.

4. The method as in claim 1, wherein two or more imaging elements are rotationally synchronized.

5. The method as in claim 3, wherein the imaging cylinder and toning roller are rotationally synchronized.

6. The method as in claim 4, wherein the period of rotation of a first synchronized imaging element is an integer multiple of the period of rotation of a second imaging element.

7. The method as in claim 5, wherein a period of rotation of the imaging cylinder is an integer multiple of a period of rotation of the toning roller.

8. The method as in claim 1, wherein the imaging element is a rotating imaging loop.

9. The method as in claim 1, wherein the one or more imaging elements includes both a rotating imaging loop and a rotating toning roller.

10. The method as in claim 9, wherein the imaging loop and toning roller are rotationally synchronized.

11. The method as in claim 10, wherein a period of rotation of the imaging loop is an integer multiple of a period of rotation of the toning roller.

12. The method as in claim 1 further comprises condensing the correction signal by grouping two or more individual pixels together.

* * * * *